US007247990B2

(12) United States Patent
Gootzen et al.

(10) Patent No.: US 7,247,990 B2
(45) Date of Patent: Jul. 24, 2007

(54) CREVICE-LESS END CLOSURE MEMBER COMPRISING A FEED-THROUGH

(75) Inventors: Albert Gootzen, Geldrop (NL); Mark Bolech, Utrecht (NL); Jean-Sebastien Straetmans, Aachen (DE); Johannes F. M. Cillessen, Deurne (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 153 days.

(21) Appl. No.: 10/535,641

(22) PCT Filed: Nov. 14, 2003

(86) PCT No.: PCT/IB03/05185

§ 371 (c)(1),
(2), (4) Date: May 20, 2005

(87) PCT Pub. No.: WO2004/049389

PCT Pub. Date: Jun. 10, 2004

(65) Prior Publication Data

US 2006/0071597 A1 Apr. 6, 2006

(30) Foreign Application Priority Data

Nov. 25, 2002 (EP) ..... 02102638

(51) Int. Cl.
*H01J 17/18* (2006.01)

(52) U.S. Cl. ..... 313/623; 313/624; 313/625

(58) Field of Classification Search ..... 313/623, 313/624, 625

See application file for complete search history.

(56) References Cited

U.S. PATENT DOCUMENTS

| | | | | |
|---|---|---|---|---|
| 3,450,924 | A * | 6/1969 | Knochel et al. | 313/625 |
| 4,019,078 | A | 4/1977 | Burgess | |
| 4,765,820 | A * | 8/1988 | Naganawa et al. | 65/36 |
| 4,803,403 | A | 2/1989 | Makar, Jr. et al. | |
| 5,286,227 | A | 2/1994 | Numajiri et al. | |
| 5,404,077 | A | 4/1995 | Eichelbroenner et al. | |
| 5,424,608 | A | 6/1995 | Juengst et al. | |
| 5,742,123 | A | 4/1998 | Nagayama | |
| 5,810,635 | A | 9/1998 | Heider et al. | |
| 6,194,832 | B1 | 2/2001 | Juengst | |
| 2002/0070668 | A1 | 6/2002 | Levis et al. | |

FOREIGN PATENT DOCUMENTS

| | | |
|---|---|---|
| EP | 1043754 A1 | 10/2000 |
| EP | 1043754 B1 | 10/2000 |
| GB | 744184 | 2/1956 |
| WO | WO 00/67294 | 11/2000 |
| WO | WO0067294 | 11/2000 |

* cited by examiner

*Primary Examiner*—Vip Patel

(57) ABSTRACT

An end closure member (1) with a feed-through (5) having a feed-through entry opening (8) and a feed-through exit opening (9) and connection means (10) for forming a gas-tight connection between the end closure member (1) and the feed-through (5), the feed-through entry opening (8) cross-section being larger than the feed-through exit opening (9), and the connection means (10) being located in the area of the feed-through exit opening (9).

14 Claims, 3 Drawing Sheets

CREVICE-LESS END CLOSURE MEMBER COMPRISING A FEED-THROUGH

The present invention relates to a high-pressure discharge lamp, such as for instance an automotive lamp used for head lighting applications, comprising a ceramic discharge vessel with at least one opening, gas tight closed by an end closure device. More precisely, said invention relates to a metal halide lamp comprising a substantially cylindrical discharge vessel having a ceramic wall, which encloses a discharge space characterized by an internal diameter. Said discharge vessel is closed by means of end closure devices, where electrodes are arranged therein, whose tips have a mutual spacing between which a discharge is maintained. Said electrode is connected to an electric current conductor by means of a feed-through element, which protrudes into said end closure device with a tight fit, and is connected thereto in a gas tight manner by help of connection means. Said discharge vessel is filled with an ionisable filling. Said filling comprises inert gas such as for instance Xenon, and ionisable salts. Said invention relates to the design of the end closure member of said end closure device, more precisely to the design of said end closure device feed-through opening, i.e. to the design of the end closure member, where a feed through is arranged therein and gas tight connected thereto.

High-pressure discharge lamps and related manufacturing processes are known from a prior art. Nevertheless, it is still necessary to provide a manufacturing process of said high-pressure discharge lamps avoiding the drawbacks known from said prior art. Due to said high pressure filling, gas tight closing said high-pressure discharge lamp discharge vessel causes several problems. Heating said discharge vessel for gas tight sealing leads said internal filling to expand or evaporate. As a result, filling gas expansion causes a bad quality seal, and filling salts evaporation gives unexpected lamp characteristics. Said seal is then characterized in that it ends up with an irreproducible length, since expanding gas tends to push it outwards from said discharge vessel. Moreover said seal will contain defects, such as gas bubbles, leading to cracks, which weakens the seal mechanical strength, leading to leakage.

In order to prevent the expansion or evaporation of said filling, several attempts to find alternative sealing processes and designs have been made.

WO 00/67294 describes a high-pressure discharge lamp, more precisely a metal halide one, with a very small, very high-pressure filled vessel, surrounded by a gas filled outer bulb.

Said lamp has the advantage of having a discharge vessel with very compact dimensions, which makes it highly suitable for head lighting applications in motor vehicles. Thanks to the discharge vessel internal diameter, small compared to the electrode spacing, the discharge arc is sufficiently straight, and its light emitting surface sufficiently sharply limited, so that it can be used as a light source in an automotive headlamp, especially in a headlamp with a complex-shape reflector.

The drawbacks of the known lamp are however a relative loss of the initial filling while heating up said lamp's discharge vessel as gas-tight closing it. It leads to a wrong colour point setting and to colour instability. Drawbacks also comprise an irreproducible initial sealing ceramic length while gas tight closing said discharge vessel, a sealing ceramic cracking behaviour within the high lamp-operating temperature range, which leads to a leaky seal. Furthermore said discharge vessel end construction design comprise a wide clearance, between said feed-through outer surface and the ceramic plug inner wall, which leads to colour instability. These drawbacks are caused by the current sealing process, or are related to the current sealing design. Said process is actually heating far too much surface of said filled discharge vessel, and said design is leaving far too much clearance between said feed-through and said ceramic plug. Both the feed-through and the ceramic plug are furthermore made of inappropriate thermo mechanically matching materials.

U.S. Pat. No. 5,810,635 A1 describes a ceramic discharge vessel for a high-pressure discharge lamp, which comprises a pin-like feed-through inserted into a plug, made from a thermo mechanically matching composite material. The feed-through has been sintered directly into the plug. Additionally, said feed-through has been sealed to the plug, by covering its surrounding area facing away from the discharge vessel with a ceramic sealing material. The main purpose of the invention is to obtain long-time gas tightness, whereby it is firstly ensured by the tight fit of the feed-through sintered into the composite plug, and later ensured by sealing ceramic material facing away from the discharge vessel as the sintering fit gets loose. The sequencing of the ceramic discharge vessel closure is of a primary importance: first the composite plug with sintered feed-through is sintered at the end of the vessel, and then the filling is performed through a small hole either located in one tubular-shaped feed-through or through a discharge vessel side hole. Eventually the small aperture is closed. This invention is addressing the issues of sealing frit length, clearance between feed-through and the ceramic plug, and heating a filled discharge vessel while closing the plug.

It turns out, however, that the end construction design and process mentioned in U.S. Pat. No. 5,810,635 A1 has two major drawbacks. Firstly, the use of a tubular-shaped feed-through design, or a side-pierced discharge vessel design, through which the filling could be introduced to the discharge cavity, is very difficult in a very small and compact burner. Moreover, a tubular feed through design is very difficult as one of its parts is usually made of a thin composite material such as cermet. Consequently, the proposed process sequencing related to the described lamp manufacture, that is to say closing the discharge vessel first and then filling it, cannot be applied for very compact burners.

The lamp previously mentioned has the disadvantage that it can form a crevice between the feed through and the end closure device as for instance when the sintering tight fit gets loose due to thermo mechanical mismatching.

Gas-tight closing said discharge vessel causes several problems.

One object of the present invention is to provide a metal halide lamp wherein the aforementioned drawbacks are alleviated. In order to achieve this goal, the proposed sealing design is aiming at reducing the crevice between a feed-through and an end closure device.

Another aspect is, that after the feed-through has been arranged in the end closure device feed-through-opening, respectively the end closure member feed-through-opening, a crevice remains, which acts as coldest spot, along which de-mixed salts can condensate and form corrosive salt pools, for instance at the extremity of said crevice near the seal. Such crevices then encourage color instability and seal corrosion.

However, said "coldest spot" is encouraging the condensation of the de-mixed ionisable salt filling. The longer the crevice along the burner main symmetry axis, the further the coldest spot from the relatively hot discharge vessel, therefore the lower the temperature of the coldest spot.

De-mixed ionisable salts filling condensation negatively affects the color co-ordinates and color stability of the lamp. Furthermore, one of the corrosive salt pools, located in the crevice against the seal, negatively affects the long-time gas-tightness of the high-pressure discharge vessel. Therefore, lifetime of such a lamp is unsatisfactory.

In order to overcome the drawbacks known from a prior art, it is necessary to provide an end closure member design, which is crevice-less, i.e. which has improved chemical resistance properties and reduced room for salts condensation.

Therefore it is an object of the present invention to provide a corrosion resistant end closure device.

It is a further object of the present invention to provide a crevice-less end closure device.

Both issues are addressed through an end closure device arranging at least one feed-through, whereby the end closure device has at least one through-going feed-through opening, whereby its cross-section, the dimensions, and/or the diameter of the through going feed-through opening varies along the main symmetry axis of the burner.

The feed-through of the present invention comprises an electrode located at one end thereof.

The cross-section of the end closure member through-going feed-through opening, along a plan perpendicular to the burner main symmetry axis, can have any suitable form. Preferably, the end closure member through-going feed-through opening cross-section has a shape of a triangle, a square, a circle, a polygon, an ellipse, or a rectangle. The end closure member through-going feed-through opening cross-section can have any suitable form; preferably said cross-section has the profile of a cone, a parabola, a hyperbola, an ellipse, a hemisphere, a Y-like profile, an O-like profile, a T-like profile or a X-like profile.

The ratio between the area of the smallest through-going-feed-through opening cross-section and the area of the largest through-going-feed-through opening cross section is $\leqq 1$ and $>0$, preferably the ratio between said areas is $\leqq 0.5$ and $>0$, more preferably said ratio is $\leqq 0.2$ and $>0$. Obviously, small variations of the feed-through opening cross-section areas, caused by deformations due to the sintering process, manufacturing tolerances or any other unplanned tolerances are not variations of the feed-through opening cross-section areas in the sense of the innovation.

Preferably the difference between the area of the largest through-going-feed-through opening cross-section and the area of the smallest through-going-feed-through opening cross section is $>0$ mm$^2$, preferably the difference between the areas is $\geqq 1.5$ mm$^2$, more preferably the difference is $\geqq 5.0$ mm$^2$, and most preferably the difference is $\geqq 13.4$ mm$^2$. Obviously, small variations of the feed-through opening cross-section areas, caused by deformations due to the sintering process, manufacturing tolerances or any other unplanned tolerances, are not variations of the feed-through opening cross-section areas in the sense of the invention.

In the present case, if the feed-though opening cross-section has a circular profile, the difference between the largest diameter of the feed-through cross-section and the smallest diameter of the feed-through cross-section is $>0$ mm, preferably the difference between the largest diameter and the smallest diameter is $>1.2$ mm, more preferably the difference is $>2.0$ mm, and most preferably the difference is $>2.7$ mm.

However, the end closure member feed-through opening cross-section, the dimensions, and/or the diameter thereof must be at least slightly larger than the feed-through cross-section, the dimensions, and/or diameter arranged in said feed-through opening. Thus, when the feed-through is arranged in said feed-through opening, a small crevice is formed between the feed-through and the end closure member. According to the present invention, the feed-through opening is formed such as said crevice can be filled with connection means so that de-mixed ionisable salt filling condensation in said crevice could be significantly reduced.

According to the present invention, the end closure member feed-through opening has a feed-through entry opening and a feed-through exit opening. The electrode side of the feed-through is arranged inside the entry opening. Preferably, the electrode of the feed-through comes through the exit opening located at the other end of the end closure member feed-through opening.

In a preferred embodiment of the present invention, the cross-section, the dimensions, and/or the diameter of the end closure member feed-through entry opening is larger than the cross-section, the dimensions, and/or the diameter of the feed-through exit opening. This geometry eases the insertion of the feed-through in the feed-through opening. Moreover, said geometry enables the connecting means and/or connection processes like resistance welding between feed-through and the end closure member to be located very close to the feed-through exit opening, or respectively directly at said feed-through exit opening, in order to achieve a gas tight connection between said feed-through and said end closure member with a minimal crevice, or respectively with no crevice at all. Thanks to said crevice-less feed-through opening design, room for de-mixed ionisable salts can be reduced.

The end closure member has a shape fitting to the end part of the discharge vessel. Said shape depends on the location where the end closure member is mounted. The end closure member can be inserted into the end opening of the end part. In such a case the end closure member can have the form of a plug. The end closure member can be arranged so that it contacts the end opening outer end part. In such a case, the end closure member can have the form of a disc or of an end cap. Preferably, the cap can at least partly surround the end opening outer end part. Indeed, the end closure member can be advantageously located partly inside said end opening and partly outside. In such a case the end closure member can have the form of a cork.

However, the end closure member is substantially tubular shaped; preferably said shape has a cork-like, a disk-like, a plug-like, and/or an end cap-like profile.

Another preferred embodiment of the present invention is an end closure member with connection means, whereby the feed-through is gas-tight connected to the feed-through opening, and whereby the gas-tight connection is formed very close to the exit opening, preferably is located at the exit opening. By locating the connection very close or at the feed-through exit opening, a minimal or no crevice is formed, so that there is less room for salt pools formation.

Preferably, the end closure member of the present invention is made of any thermo mechanical matching and corrosive resistant material, i.e. of a material that is proven to be stable under high-pressure discharge lamp operating conditions.

In a preferred embodiment of the present invention the end closure member materials comprise metals, metal alloys, coated metals, metal assemblies, and/or cermet materials. More preferably, said end closure member is of cermet material. Most preferably, said cermet material is a functionally graded material.

A discharge vessel is usually closed by an end-closure-device, in order to provide a gas-tight high-pressure burner. The end closure device as used in the present invention is in its simplest form an assembly of an end closure member with a feed-through opening and a feed-through arranged therein. The feed-through is gas-tight connected to said end closure member. The end closure device can comprise at least one feed-through opening and at least one feed-through arranged therein. The end closure device can be gas-tight connected to the discharge vessel by connection means and/or coating layers improving the connection means binding properties. The use of coating layers together with connection means can improve the bond with the discharge vessel and/or with the end closure device.

The end-closure device materials should have a thermal expansion coefficient matching the one of the discharge vessel, so that no stress or crack builds up during the sealing process and the thermal cycles of the operating burner later on. Thus, the end closure device, preferably end closure member and/or connection means, is made of a metal, preferably Mo, a coated metal, preferably Ta coated with Mo or $Al_2O_3$, a metal alloy, preferably an inter-metallic such as $Mo_3Al$, of a cermet, and/or of a ceramic, preferably $Al_2O_3$. Should the end closure device be made of a cermet material, it would preferably be a functionally graded material.

A suitable cermet material used according to the present invention has a substantially continuous gradient of at least compounds A and B, whereby the concentration of material compound A substantially increases in the same degree, in that the concentration of material compound B decreases. The concentration gradient can preferably be described with any linear or non-linear function.

Preferably, the weight ratio of compounds A and B increase, so that one end matches the expansion coefficient of the discharge vessel. For instance, if the discharge vessel were made of $Al_2O_3$, which expansion coefficient is $8 \cdot 10^{-6}$ $K^{-1}$, one of said compounds would match this coefficient. Should the discharge vessel be made of another material, such as for instance YAG, YbAG or AlN, one of said compounds would be chosen to match its expansion coefficient. The other end must be weld-able.

The cermet material comprising a gradient of at least compounds A and B is characterized in that it has an outer layer, in which the concentration of material compounds A and B are constant.

Preferably the weight percent ratio of compounds A and B in the opposed highest and lowest layer set such as the highest layer comprises $\leqq 100\%$ weight-% A and $\geqq 0$ weight-% B, and the lowest layer comprises $\leqq 100\%$ weight-% B and $\geqq 0$ weight-% A; alternatively the lowest layer comprises $\leqq 100\%$ weight-% A and $\geqq 0$ weight-% B and the highest layer comprises $\leqq 100\%$ weight-% B and $\geqq 0$ weight-% A.

Said layer can have a thickness from 0 to 500 μm, preferably from 0 to 50 μm and most preferably from 0 to 5 μm.

The compound A can be $Al_2O_3$ and the component B can be Mo. Other compounds can be mixed additionally to A and B in the same graded, or in an ungraded, manner.

In a preferred embodiment of the present invention, a gas-tight high-pressure burner comprises at least one of said end closure members with at least one feed-through.

Furthermore, a lamp, preferably a high-pressure discharge lamp, most preferably a Xenon high-pressure discharge lamp mounted in a headlamp, can comprise at least one of said end closure members, where at least one feed-through is arranged therein and gas tight connected thereto.

A third aspect of the present invention is to provide a method of manufacturing a gas tight high-pressure burner, comprising at least one end closure device, at least two feed-through parts, and at least one discharge vessel, with at least one end opening, whereby said method comprises the following steps:

i) Filling said discharge vessel with an ionisable filling through at least one opening, and ii) Closing said opening by arranging a feed-through therein, followed by gas tight connecting said feed-through to the end closure device and/or to the discharge vessel, whereby a gas tight high-pressure burner is obtained.

These and other aspects of the invention will be apparent from and elucidated with reference to the embodiments described hereinafter.

FIG. 1 shows a cross-section along the longitudinal axis of an end closure member, the end part of a discharge vessel, and a feed-through, FIG. 2 shows a cross-section along the longitudinal direction of a gas-tight high-pressure burner with an end closure member and a feed-through, FIGS. 3 to 6 shows end closure member cross-sections with various shapes, FIGS. 7 to 13 shows feed-through opening cross-sections with various shapes, FIG. 1 depicts an end closure member 1 with one through-going feed-through opening 2. The end closure member 1 is arranged in a discharge vessel 3, more precisely in an end opening 4 of an end part of a discharge vessel 3. A feed-through 5 with an electrode 6 is arranged in the feed-through opening 2 of said end closure member 1. The feed-through 5 goes through both frontal sides 7 of the end closure member 1, whereby one end of said feed-through 5 projects into the end opening 4 of the discharge vessel 3. The cross-section of the feed-through opening 2 varies in longitudinal direction from a first frontal side 7*a* facing away from the discharge cavity to a second frontal side 7*b* facing the discharge cavity, whereby the cross-section of the feed-through entry opening 8 is larger than the cross-section of the feed-through exit opening 9. The feed-through opening 2 is divided into two cylindrical parts with different diameters and one conic part. The feed-through 5, arranged in the feed-through opening 2 of the end closure member 1, is connected near the feed-through exit opening 9 by connection means 10. The outer form of the end closure member 1 is shaped as a plug fitting into the end opening 4 of the discharge vessel 3.

FIG. 2 shows a gas-tight high-pressure burner 11 having two end closure members 1 each shaped as an end cap and each connected with a feed-through arranged in a corresponding feed-through opening 2. Each feed-through opening 2 is shaped as a cone with a larger circular feed-through entry opening 8 and a smaller feed-through exit opening 9. The connection means 10, which connect the feed-through to the end closure member 1 are located very close, respectively directly to the feed-through exit opening, so that practically no crevice is formed.

FIG. 3 shows an end closure member 1 having a disc-like outer shape. The end closure member 1 is located in front of the end opening of the discharge vessel.

FIG. 4 shows an end closure member 1 with an outer form shaped as an end cap. The end closure member 1 partly surrounds the discharge vessel.

FIG. 5 shows an end closure member 1 having an outer form shaped as a cork. The end closure member 1 is located partly in front of the end opening and partly into the end opening of the discharge vessel.

FIG. 6 shows an end closure member 1 with a plug-like outer form. The end closure member 1 is inserted partly into end opening of the discharge vessel.

Various shapes of feed-through openings are shown in FIGS. 7 to 14.

Figure 1:
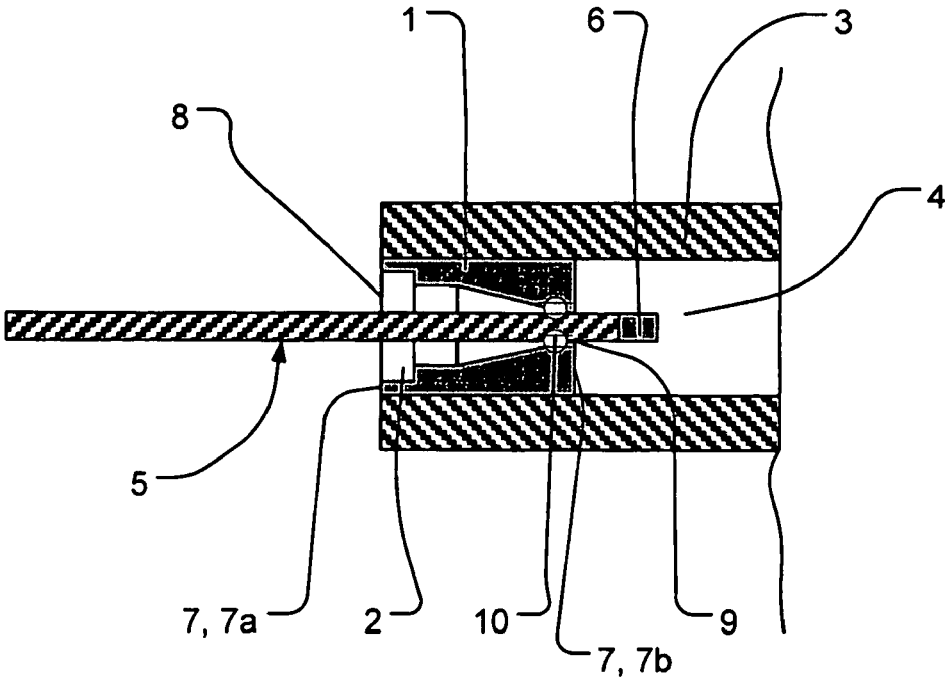
Figure 2:
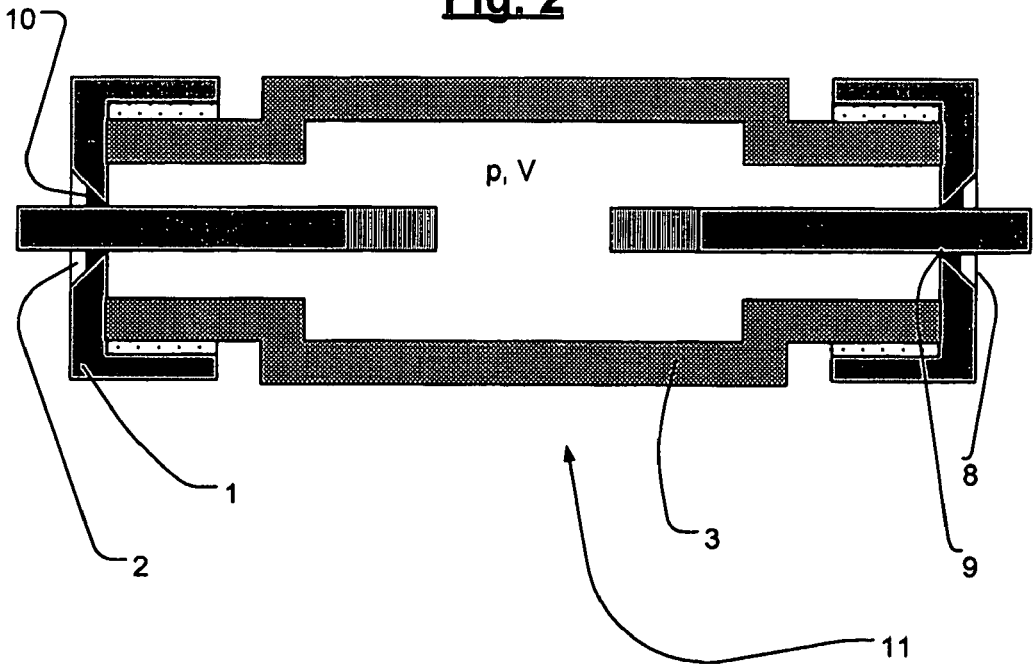
Figure 3:
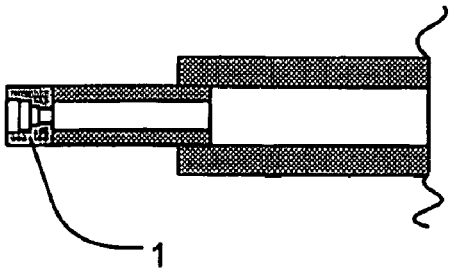
FIGS. 3 to 6 show end closure members with various outer shapes.
Figure 4:
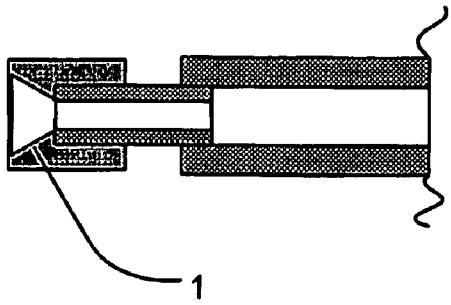
Figure 5:
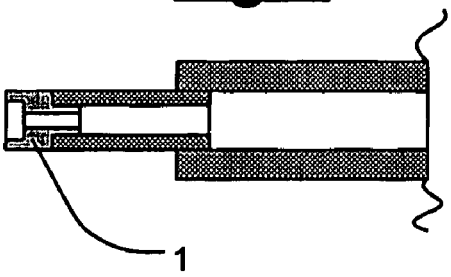
Figure 6:
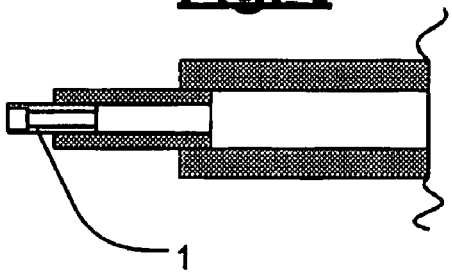
Figure 7:
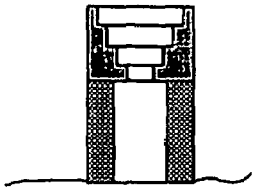

FIG. 7 shows a feed-through opening profile made of different cylindrical parts, whereby the diameter of the different parts decrease stepwise from one part to the next.

Figure 8:
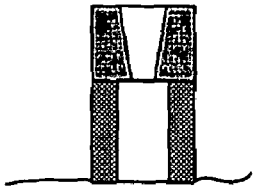

FIG. 8 shows a conical feed-through opening profile, whereby the diameter of the cone decreases continuously from the feed-through entry opening to the feed-through exit opening of the end closure member.

Figure 9:
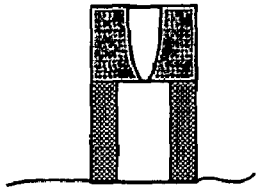

FIG. 9 shows a feed-through opening profile shaped as a parabola with a larger feed-through entry opening compared to the feed-through exit opening.

Figure 10:
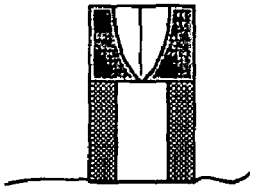

FIG. 10 shows another feed-through opening profile. The profile in FIG. 10 has the form of an ellipse.

Figure 11:
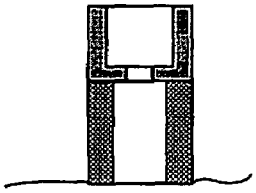

FIG. 11 shows a T-like feed-through opening profile. This profile is a special configuration of the profile shown in FIG. 7, whereby the T-like feed-through opening profile is made of only two cylindrical parts.

Figure 12:
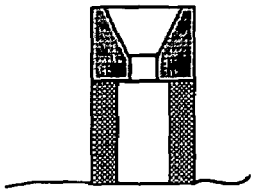

FIG. 12 shows a Y-like feed-through opening profile. This profile is a combination of a conical profile at the feed-through entry opening side and of a cylindrical profile at the feed-through exit opening side.

Figure 13:
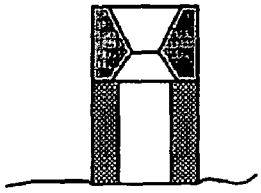

FIG. 13 shows an X-like feed-through opening profile having two conical parts. Each conical part becomes smaller from the frontal side of the end closure member to the middle of the end closure member, so that the longitudinal cross-section is shaped as a X-like profile.

LIST REFERENCE NUMBERS

1 End closure member
2 Feed-through opening
3 Discharge vessel
4 End opening (of the discharge vessel)
5 Feed-through
6 Electrode
7 Frontal side (of the end closure member)
7*a* First frontal side (of the end closure member)
7*b* Second frontal side (of the end closure member)
8 Feed-through entry opening
9 Feed-through exit opening
10 Connection means
11 Gas-tight high-pressure burner

The invention claimed is:

1. End closure member (1) with at least one feed-through (5), characterized in that the end closure member (1) has at least one through-going feed-through opening (2) having a feed-through entry opening (8) and a feed-through exit opening (9) and connection means (10) for forming a gas-tight connection between end closure member (1) and feed-through (5), whereby the feed-through entry opening (8) cross-section is larger than the feed-through exit opening (9), and connection means (10) is located at least close to the area of the feed-through exit opening (9).

2. End closure member (1) according to claim 1, characterized in that the ratio between the area of the smallest through-going feed-through opening cross-section is $\leqq 1$ and $>0$ and/or the difference between the area of the largest through-going feed-through opening cross-section and the area of the smallest through-going feed-through opening cross-section is $>0$ $mm^2$.

3. End closure member (1) according to claim 2, characterized in that the difference between the areas is $\geqq 1.5$ $mm^2$.

4. End closure member (1) according to claim 3, characterized in that the difference between the areas is $\geqq 5.0$ $mm^2$.

5. End closure member (1) according to claim 4, characterized in that the difference between the areas is $\geqq 13.4$ $mm^2$.

6. End closure member (1) according to claim 1, characterized in that the end closure member (1) is a metal, a metal alloy, a coated metal, a metal assembly, and/or a cermet material, preferably a cermet, and most preferably the cermet material has a gradient.

7. End closure member (1) according to claim 1, characterized in that the end closure member (1) is substantially tubular shaped, preferably the shape has a profile from the group comprising a cork, a disk, a plug, and/or an end cap.

8. End closure member (1) according to claim 1, characterized in that the longitudinal feed-through opening (2) cross-section has the form of a cone, a parabola, a hyperbola, an ellipse, a hemisphere, a Y-profile, an X-profile, a T-profile, or a V-profile.

9. Gastight high-pressure burner (11) comprising at least one end closure member (1) with a feed-through (5) according to claim 1.

10. Lamp, comprising at least one gas-tight high-pressure burner (11) according to claim 9, whereby the lamp is preferably arranged in an automotive headlamp unit.

11. Method of manufacturing a gas-tight high-pressure burner (11) comprising a) at least one end closure member (1) according to claim 1, and b) at least one discharge vessel (3) with at least one end opening (4), whereby the manufacturing method comprises the steps:

i) filling said discharge vessel (3) with an ionisable filling through at least one feed-through opening (2), and ii) closing said feed-through opening (2) by arranging a feed-through (5) in said feed-through opening (2) followed by gas-tight connecting said feed-through (5) with the end closure member (1), whereby a gas-tight high-pressure burner (11) is obtained.

12. End closure member (1) according to claim 1, characterized in that connection means (10) is located directly at the feed-through exit opening (9).

13. End closure member (1) according to claim 12, characterized in that the ratio is $\leqq 0.5$ and $>0$.

14. End closure member (1) according to claim 12, characterized in that the ratio is $\leqq 0.2$ and $>0$.

* * * * *